US006575007B2

(12) United States Patent
Hein et al.

(10) Patent No.: US 6,575,007 B2
(45) Date of Patent: Jun. 10, 2003

(54) DEVICE FOR FORMING A HOLLOW PROFILE BY MEANS OF INTERNAL HIGH PRESSURE FORMING

(75) Inventors: Jörg Hein, Steisslingen (DE); André Rost, Singen (DE); Aslan Göger, Marxen (DE)

(73) Assignee: Alcan Technology & Management Ltd., Neuhausen am Rheinfall (CH)

( * ) Notice: Subject to any disclaimer, the term of this patent is extended or adjusted under 35 U.S.C. 154(b) by 142 days.

(21) Appl. No.: 09/899,465

(22) Filed: Jul. 5, 2001

(65) Prior Publication Data

US 2002/0002851 A1 Jan. 10, 2002

(51) Int. Cl.[7] ..... B21D 22/10; B21D 39/20; B23P 17/00

(52) U.S. Cl. ..... 72/61; 72/58; 29/421.1; 29/370.22

(58) Field of Search ..... 72/58, 61, 62, 72/370.22; 29/421.1

(56) References Cited

U.S. PATENT DOCUMENTS

| | | | | | |
|---|---|---|---|---|---|
| 2,245,887 | A | | 6/1941 | Wilkander | |
| 2,837,810 | A | * | 6/1958 | Ekholm | 72/62 |
| 4,393,674 | A | * | 7/1983 | Rasmussen | 72/61 |
| 4,660,269 | A | * | 4/1987 | Suzuki | 29/421.1 |
| 4,761,982 | A | * | 8/1988 | Snyder | 72/58 |
| 5,038,830 | A | | 8/1991 | Arnaud | |
| 5,170,557 | A | * | 12/1992 | Rigsby | 72/61 |
| 5,233,854 | A | * | 8/1993 | Bowman et al. | 72/58 |
| 5,303,570 | A | * | 4/1994 | Kaiser | 72/62 |
| 5,363,544 | A | * | 11/1994 | Wells et al. | 72/370.22 |
| 6,065,502 | A | * | 5/2000 | Horton | 72/61 |
| 6,128,936 | A | * | 10/2000 | Yogo | 72/58 |
| 6,266,986 | B1 | * | 7/2001 | Morita et al. | 72/58 |
| 6,279,364 | B1 | * | 8/2001 | Morphy et al. | 72/58 |
| 6,397,449 | B1 | * | 6/2002 | Mason et al. | 29/421.1 |

FOREIGN PATENT DOCUMENTS

| | | |
|---|---|---|
| DE | 1 068 206 | 11/1959 |
| DE | 199 09 927 | 9/2000 |
| EP | 225 573 | 6/1987 |

* cited by examiner

*Primary Examiner*—David Jones
(74) *Attorney, Agent, or Firm*—Ostrolenk, Faber, Gerb & Soffen, LLP

(57) ABSTRACT

A device for forming a hollow profile formed as a multi-chamber profile by an internal high pressure generated by a fluid pressure medium within the hollow profile containing a sealing die engaging in the profile chamber with a carrier part and a collar arranged on the carrier part sealing the face side of the profile chamber. The die also has a passage opening as a pressure medium supply and/or extraction channel. The collar is a resilient rubber die part arranged on the face of the carrier part facing the profile chamber and on the free face of the collar is provided a preload plate which is anchored by way of the fixing member penetrating the collar in the carrier part lying on the collar so that the collar is squeeze-clamped between the preload plate and the carrier part.

33 Claims, 7 Drawing Sheets

DEVICE FOR FORMING A HOLLOW PROFILE BY MEANS OF INTERNAL HIGH PRESSURE FORMING

BACKGROUND OF THE INVENTION

The present invention concerns a device for forming a hollow profile formed as a single or multi-chamber profile by means of an internal high pressure generated by a fluid pressure medium within the hollow profile, containing a sealing die engaging in the profile chamber with a carrier part and, arranged directly or indirectly on the carrier part and sealing the face of a profile chamber, a collar with a base part and containing at least one passage opening as a pressure medium supply and/or extraction channel, and a process for internal high pressure forming.

In internal high pressure forming, referred to below as the IHU process, a hollow profile is expanded by internal pressure. For this the faces of the hollow profile are sealed in order to build up and maintain an excess pressure in the interior by means of a pressure medium. The excess pressure leads to an expansion of the hollow profile. The hollow profile assumes the form preset by the tool mold in which the hollow profile was previously laid. Former sealing processes use conical metal sealing dies in particular steel dies, which are introduced into the hollow profile. In addition, the hollow profile can be pushed further by means of at least one die part acting on the face of the workpiece. In this way it is possible to expand or swage the workpiece.

In a double or multi-chamber profile, the webs between the individual chambers stretch during forming differently from the other walls or outer contours, and the die is unable to compensate for the uneven distortion. If the tolerances of the profile cross-section are selected to be too large, e.g. more than 0.1 mm, sealing in the conventional manner is not possible. This had led to attempts to use sealing dies of plastic, in particular polyurethane.

However, conventional sealing dies with polyurethane collars wear quickly due to the friction occurring on introduction into the hollow profile and excessive compressive stresses at sharp corners and step-like changes in wall thickness of the collar. If the form of the profile deviates too greatly from the nominal values, the sealing element must be introduced even further which increases the wear. Also, the required sealing effect can no longer be achieved.

SUMMARY OF THE INVENTION

In view of these circumstances it is an object of the present invention to provide a reliable and comparatively simple sealing system suitable for series production, in particular for multi-chamber profiles, which ensures optimum sealing capacity in the mating between the hollow profile, in particular the multi-chamber hollow profile, and the die, and improved die tool lives. The increase in tool life in standard operation should lead to a reduction in operating costs.

The task according to the invention is solved in that the collar is a resilient rubber die part arranged on the face of the carrier part facing the profile chamber and the base part is designed block-like and the outer wall of the base part is formed conical completely or at least in its end section facing the profile chamber and tapering towards the profile chamber, and the stop point of the profile chamber face which is effective for sealing for forming lies on the conical section of the outer wall of the base part.

The die according to the invention is aligned with the longitudinal die axis x which corresponds suitably to the direction of insertion of the die. The collar preferably comprises or contains a plastic with limited resilience. The collar in particular comprises or contains in particular polyurethane. The base part of the collar is characterised by a solid compact block-like structure. The base part has for example a diameter to height ratio of 0.5 to 6, in particular from 1.5 to 5.

In the preferred embodiment, on the free face of the base part is arranged a preload plate anchored by way of fixing means in the carrier part lying directly or indirectly on the collar, and preloading the collar and mounted to be twist-resistant.

The preload plate is a flat plate-like element and suitably consists of a high strength material so that it can exert a contact pressure on the collar in the preloaded state without itself being substantially deformed. The preload plate preferably consists of a ferrous or non-ferrous metal, in particular steel. The preload plate suitably has a through-bore preferably arranged centrally, which advantageously serves as a passage opening for the pressure medium supply and/or extraction. The area of the preload plate is preferably more than 60%, in particular more than 75%, of the average cross-sectional area of the collar.

The collar lies with a base surface on the carrier part. On the side opposite the base surface the collar contains a free face. The collar also has a passage opening, preferably arranged centrally, aligned with the passage opening of the preload plate and which constitutes the continuation of the pressure medium supply and/or extraction channel.

The peripheral geometry of the collar is suitably adapted to the inner contour of the profile chamber of the chamber profile. The base part of the collar suitably has an outer wall around its full periphery. The outer wall of the base part can run completely or in sections parallel to the die longitudinal axis x or taper in the direction of the free face i.e. in the insertion direction of the die.

In the latter case the acute angle enclosed by the outer wall and the die longitudinal axis x is preferably less than 20°, in particular less than 10° (angle degrees) and preferably greater than 0°, in particular greater than 3°. The outer wall of the base part preferably contains the stop point of the profile chamber face effective for sealing for profile forming.

In a preferred embodiment of the invention, the outer wall of the base part is formed conically completely or at least in its end section facing the profile chamber and tapering towards the profile chamber, and the stop part of the profile chamber face effective for sealing is provided on the conical section of the outer wall of the base part for profile forming.

The outer wall can also have a more strongly tapering end section wall in the transition to the face in the insertion direction of the die. The surfaces of the outer wall and the end section wall preferably enclose an acute angle of 0° to 45° (angle degrees), in particular 10° to 30°. The greater taper of the end section wall facilitates insertion of the die into the profile chamber.

In a first embodiment of the invention the collar has a pocket-like recess arranged on the face against the profile chamber which is surrounded by a ring flange preferably on the full periphery. The pocket-like recess contains a face which is set back. In this embodiment the collar consists of a base part with outer wall and a ring flange arranged on the base part and forming the pocket-like recess, with a ring flange outer wall and a ring flange inner wall directed towards the pocket-like recess. The ring flange outer wall preferably sits at the level of the ring flange shoulder and constitutes an end section wall described above.

The ring flange can also lead merely over part sections of the total periphery of the collar, and in particular cover only the corner areas of the adjacent external walls of the collar. The cross-sectional diameters of the ring flange remain, preferably, where applicable with the exception of the corner areas, constant over the entire periphery of the collar such that the pocket-like recess and with it the preload plate substantially reproduce the cross-sectional geometry of the profile chamber.

The ring flange and base part, i.e. the collar, are suitably made of one piece. The ring flange is suitably formed bead-like. The height of the ring flange preferably corresponds to the thickness of the preload plate and in particular deviates from the thickness of the preload plate by no more than ±50%.

Between the ring flange inner wall and the face of the base part is formed a transition area. In the preferred design a curved surface, in particular a circular curved surface with radius r, connects the ring flange inner wall with the face. Radius r is preferably selected so that on the ring flange a foot-like expansion is formed. The maximum diameter e of the foot-like expansion preferably corresponds approximately to the diameter d of the ring flange in its end section. The maximum diameter e of the foot-like expansion also preferably corresponds to at least one-third of the height h, in particular at least half the height h of the ring flange. The radius r preferably also amounts to around half the ring flange diameter at its base.

The applied radius or the missing edges lead to an even distribution of stress at the foot of the ring flange in the transition from the ring flange to the base part of the collar. In contrast to conventional transitions in which the abutting walls of the ring flange and the face form a corner area, in each case enclosing an angle of around 90°, in the design according to the invention under high transverse forces acting on the ring flange in said transition area no stress peaks occur and hence no crack and rupture formation.

In a further embodiment of the invention the ring flange in said transition area also forms a foot-like expansion. However, the foot-like expansion is here preferably achieved by breaking the edge formed in the corner area by means of one or more flat or curved corner surfaces. The mutually abutting corner surfaces or the corner surface(s) abutting the ring flange inner wall or face suitably form an angle of more than 90°, preferably more than 110° and in particular more than 130°. The obtuse angle edges again generated by the corner surfaces are preferably rounded.

The ring flange outer wall tapering towards the so-called ring flange end face, and the breaks of the edges in the transition or corner area to the ring flange inner wall, give at the base a ring flange diameter which is significantly greater than, preferably around two to three times as great as, the corresponding cross-sectional diameter d at the ring flange end face. In addition, the ring flange has a preferred ratio of height h to diameter d at its end face of 0.5 to 3, in particular around 1 to 2.

The edges in the transition area of two ring flange sections intersecting at an angle, as is for example the case with a die body which is polygonal in top view, are preferably cut and rounded in the area of the ring flange inner wall. Said transition area is preferably limited by a curved piece, in particular a circular curved piece with radius s. Said radius s corresponds to or is greater than half the diameter e of the maximum foot-like expansion of the ring flange. The edge can also be cut by means of one or more flat or curved wall surfaces which in turn enclose with the adjacent wall surfaces angles of more than 90°, preferably more than 110° and in particular more than 130°. The obtuse angled edges enclosed again by the wall surfaces are preferably rounded.

In the pocket-like recess of the collar is introduced a preload plate. The preload plate preferably lies closely, and in particular tightly fitting, against the inner contour of said recess and is thus mounted secure against twisting.

The preload plate is anchored by means of fixing means penetrating the collar to a die part directly or indirectly adjacent to the collar so that by tightening said fixing means the space occupied by the collar between the preload plate and the die part is shortened and the collar clamped or squeezed between the preload plate and the opposing die part.

The fixing means are preferably anchored in the carrier part directly or indirectly adjacent to the collar. Preferred fixing means are screw connections. The screw connections preferably lie with the screw head and where applicable a washer on the preload plate and hold this firmly.

In a preferred embodiment the preload plate is anchored at least by means of a fixing screw with through-bore pushing through the passage opening in the preload plate and the collar. Said fixing screw can also be screwed into a die part lying directly or indirectly adjacent to the collar, in particular the carrier part. The through-bore in the fixing screw serves as a supply or extraction channel for the pressure medium. Furthermore, several fixing screws can be provided with or without through-bore of said type and corresponding to several supply and extraction channels for the pressure medium. The supply and extraction of the pressure medium can be guided, in the case of two or more fixing screws with through-bore, in particular through separate channels. If fixing screws with through-bore are used as supply or extraction channels for the pressure medium, said screws are preferably anchored in the through-bores with inner thread produced in the carrier part and aligning with the passage openings of the collar and preload plate.

In a further embodiment of the invention, the preload plate has no ring flange as described above, where the preload plate is placed directly on the free face. The preload plate has moldings on the face, for example in the form of pins which engage in corresponding grooves or recesses on the face of the collar. The moldings on the preload plate engage in particular with a tight fit in said recesses in the collar. When the preload plate is placed on said face, the moldings on the preload plate are inserted in the corresponding recesses so that the preload plate is mounted on the face end of the collar secure against twisting about the die longitudinal axis x.

In this design too the preload plate can be anchored or bolted by means of the fixing means described above, in particular with a fixing screw with a through-bore of the type described, penetrating the passage opening in the preload plate and the collar into a die part directly or indirectly adjacent to the collar, in particular the carrier part.

The preload plate in this embodiment can also, as described above, be anchored by means of several fixing means, in particular screw connections, such that the preload plate is mounted secure against twisting about the die longitudinal axis x and no mouldings to engage in recesses need be provided on the preload plate.

By anchoring the preload plate in a die part lying directly or indirectly opposite the preload plate, the collar can be clamped sandwich-like and where applicable squeezed by freely selectable tightening of the fixing means. The squeezed clamping of the collar causes a sideways, where applicable bead-like, expansion of this. Clamping the preload plate can compensate for seal-reducing tolerances occurring between the chamber and the die cross-sectional profile introduced in the profile chamber.

If the preload plate as described above is let into a pocket-like recess in the collar, in its dimension facing said pocket-like recess the preload plate can where applicable be dimensioned slightly larger so that by introducing the preload plate and in particular by clamping this, on the basis of the occurring wedge effect, the ring flange in particular at its base is pushed away more towards the outside i.e. towards the provided profile chamber walls.

In the preferred design the preload plate is freely displaceable in the direction of the carrier part, i.e. parallel to the die longitudinal axis x, but secure against twisting, where said anchoring of the preload plate constitutes an outer (in the direction of the profile chamber) stop point. The preload plate can thus be repelled by pressure impact by the pressure medium in the direction of the carrier part and squeeze the collar further. When the pressure medium flows, namely from the supply line into the profile chamber, it rebounds at the end against the filling current and exerts a thrust force on the preload plate so that this moves back as a function of the thrust force.

The preload plate is preferably preloaded before introduction of the die into the profile chamber. In a modified embodiment of the invention, means can be provided which allow the preload plate to be clamped or further clamped only after insertion of the die into its operating position. In this variant the friction between the collar and the profile chamber wall during introduction of the die is reduced and the wear reduced further. It can also be provided that the preload plate is also actively clamped further during the forming process.

Clamping takes place by tightening the fixing bolt(s). By clamping the preload plate it is possible to seal the profile chamber ready for operation, and compensate for tolerances in the seal.

On the periphery of a sealing collar with the geometry and composition described above, which can be introduced into the profile chamber, in a particular embodiment of the invention there is at least one additional element as wear protection made of a material of higher strength or wear resistance than the collar. The additional element consists preferably of a wear-resistant metallic material such as a ferrous or non-ferrous metal, and in particular steel. The additional element surrounds the collar in the full periphery or a part periphery or several part peripheries on the outside.

The wear protection preferably lies in an area of the collar which in the operating position at the start of the forming process of the edge lies on the face wall of the chamber profile. Thanks to this measure wear of the plastic by friction is reduced further.

In the preferred embodiment the additional element is strip-like and inserted in a corresponding groove formed in the outer wall of the base part as a wear strip. This wear strip is preferably of thin cross-section and limited flexibility, so that it can conform to the adjacent inner surface of the hollow profile. The wear strip can be a single part over the full periphery or consist of several part strips, in particular in the form of corner pieces which together surround the entire periphery or parts sections thereof.

According to a further feature of the invention, the wear strip and the receiving groove of the collar have a cross-section tapering in the direction of the profile chamber.

In a further embodiment the wear strip forms a frame, surrounding the wall of the collar, of a further die part directly adjacent to the collar and carrier part which in turn is mounted in a corresponding surface recess of the outer wall of the collar.

The outer wall of the wear strip and collar preferably align so that at the material transitions there are no shoulders or edges.

In a further embodiment, between the carrier part and the collar is a plate-like intermediate part preferably of a metal material, in particular steel, which on the surface facing the collar has a bead-like edge as wear protection. The bead-like edge preferably has an inwardly sloping outer surface which aligns with the tapering outer wall of the base part. The bead-like edge thus forms a wear strip protruding into the outer wall of the base part. The bead-like edge is preferably of thin cross-section and limited flexibility so it can conform to the adjacent inner surface of the hollow profile.

The carrier part of all embodiments can have a greater periphery than the collar and thus at the contact surface to the collar form a shoulder against which abuts the profile chamber with its face when the die is advanced into the profile chamber. This serves to push the die further to shorten or swage the profile. The sealing effect between the collar and chamber profile wall is preferably achieved in the area of the outer wall of the base part.

In a second embodiment of the invention, the die contains a collar according to one of the embodiments described above, where the collar is arranged directly or indirectly on the carrier part and seals the face of a profile chamber. The collar contains a base part. The collar can also contain a ring flange arranged on the base part according to one of the embodiments described above. The outer wall of the base part, and where applicable the ring flange, is also designed according to one of the embodiments described above. A preload plate is not provided for preference according to this embodiment.

The collar contains at least one passage opening as a pressure medium supply and/or extraction channel. The passage opening is preferably arranged in the center. The collar also contains a reinforcement bush arranged about the passage opening in the collar. The reinforcement bush is suitably a tubular or hollow cylindrical body and lies in a first embodiment flush or tightly against the wall of the passage opening in the collar. The reinforcement bush used according to a first embodiment, under radial preload of the collar in the area of the passage opening i.e. under resilient expansion of the passage opening, is suitably tightly let or pressed into this to form a seal.

In a second embodiment the reinforcement bush is integrally let into the collar surrounding the passage opening. The reinforcement bush can with regard to its connection with the collar be pushed in and/or vulcanised, glued or shrunk on. The reinforcement bush of the second design can also be cast into the base part.

The height of the reinforcement bush corresponds preferably to the height of the base part. The reinforcement bush lies with a face end flush on the carrier part or on a die part connected to the collar. The collar is anchored, by means of the fixing means penetrating the passage openings, in a die part directly or indirectly adjacent to the collar, in particular in the carrier part. Preferred fixing means are screw connections. The screw connections preferably lie with the screw head and where applicable a washer on the face of the collar and/or the reinforcement bush and fix this.

The reinforcement bush according to the invention, in particular according to a first embodiment, can have a changing external diameter over its entire length. Said external diameter of the reinforcement bush can in particular increase continuously and/or in steps towards the carrier part. With the increase in external diameter preferably the wall thickness of the reinforcement bush also increases. The reinforcement bush can in particular have a conical or stepped outer form. The internal diameter of the reinforcement bush is preferably structured so that the screw or screw shaft engages tightly in the reinforcement bush.

The use of the reinforcement bush prevents any pressure medium which penetrates the separating area between the screw shaft and the passage opening from mechanically stressing and deforming the collar in the passage opening due to radial pressure forces. With reinforcement bushes of the first design, the pressure medium can penetrate at most into the border area between the screw shaft and the reinforcement bush, where radial pressures occurring are compensated by the reinforcement bush. With reinforcement bushes of the second design, radial forces can still be exerted on the collar by the penetrating pressure medium in the area of the passage opening. The forces, however, are absorbed by the reinforcement bush surrounding the passage opening and hence are not passed on to the outside.

The reinforcement bush is made of a high strength material, in particular steel, and can absorb the pressure forces exerted by the penetrating pressure medium substantially without deformation.

Between the reinforcement bush and the screw head, for the purpose of sealing the passage opening against the profile chamber, a sealing element e.g. a sealing ring or O-ring can be arranged for preference. The sealing element is preferably a sealing ring let into an annular groove opening at the face end of the reinforcement bush.

Furthermore, between the reinforcement bush and the adjacent die part, in particular the carrier part, for the purpose of sealing the separating area between the collar and the die part or carrier part against the passage opening, a sealing element e.g. a sealing ring or O-ring can be arranged. The sealing element is preferably a sealing ring let into an annular groove opening on the face end of the reinforcement bush.

The object of the invention is also a process for internal high pressure forming of a single or multi-chamber profile by means of an internal high pressure generated by a fluid pressure medium in the sealed profile chamber of the chamber profile using a device according to the invention, where dies are introduced into the profile chambers of the chamber profile and the collar of the die tightly seals the face opening of the profile chamber and a pressure medium is introduced into the profile chamber by way of a pressure supply line.

The process is characterised in that a preload plate lying on the face of the collar is anchored and clamped, before or after introduction of the die into the profile chamber, by fixing means squeezing the collar, in a die part lying directly or indirectly adjacent to the collar and opposite the preload plate, so that tolerances between the die and the chamber walls are compensated.

In a particular embodiment of the process, by clamping the preload plate and squeezing of the collar, the ring flange is pressed outwards in the direction of the provided profile chamber walls.

The device according to the invention is suitable in particular for internal high pressure forming of multi-chamber profiles. For each profile chamber a die is provided with an associated collar and preload plate according to the description above. The individual dies for a multi-chamber profile can be guided independently of each other. Furthermore, the individual dies for one face of the multi-chamber profile can be connected by way of a common carrier element or other element to form a common guided die arrangement.

With the die according to the invention, tolerances in the chamber profile or workpiece can be compensated by the sealing die. In addition, no further sealing force is required. Uneven expansion of the hollow profile, i.e. the individual profile chambers, can be compensated by the die. The die according to the invention also has a simple structure and is correspondingly cheap to produce and maintenance-friendly. Thanks to the preload plate, the wear between the collar and fixing means, e.g. screws, can be reduced as in particular the screws lie with their screw heads or washer elements on the wear-resistant preload plate.

BRIEF DESCRIPTION OF THE DRAWINGS

The invention is described in more detail below with reference to the enclosed drawings. These show.

DETAILED DESCRIPTION OF THE DRAWINGS

Figure 1:
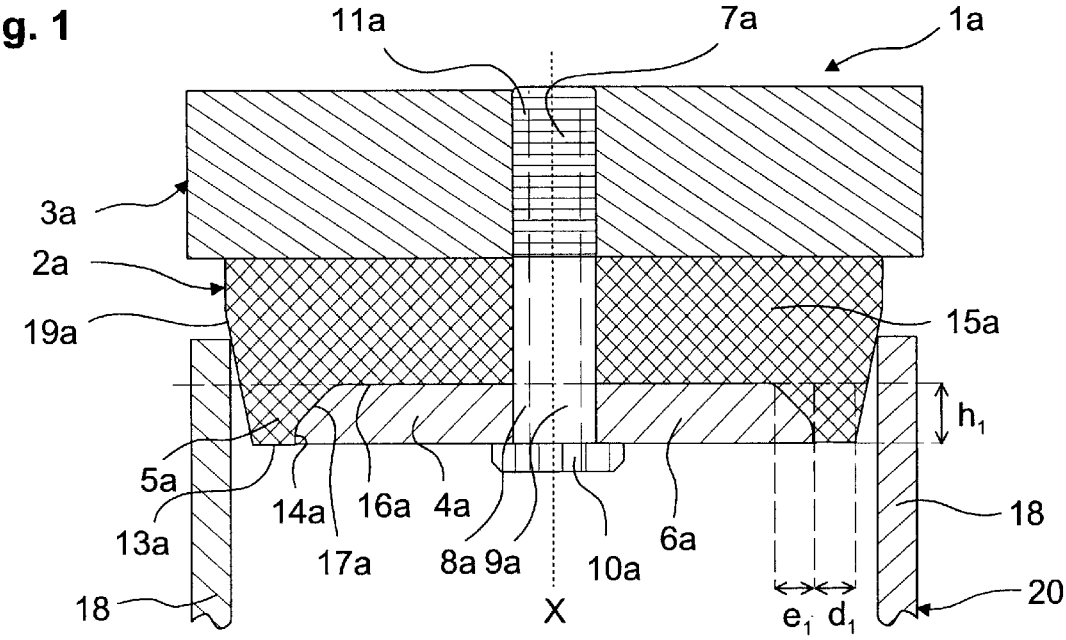
FIG. 1: a cross-section through a die according to the invention.
Figure 2:
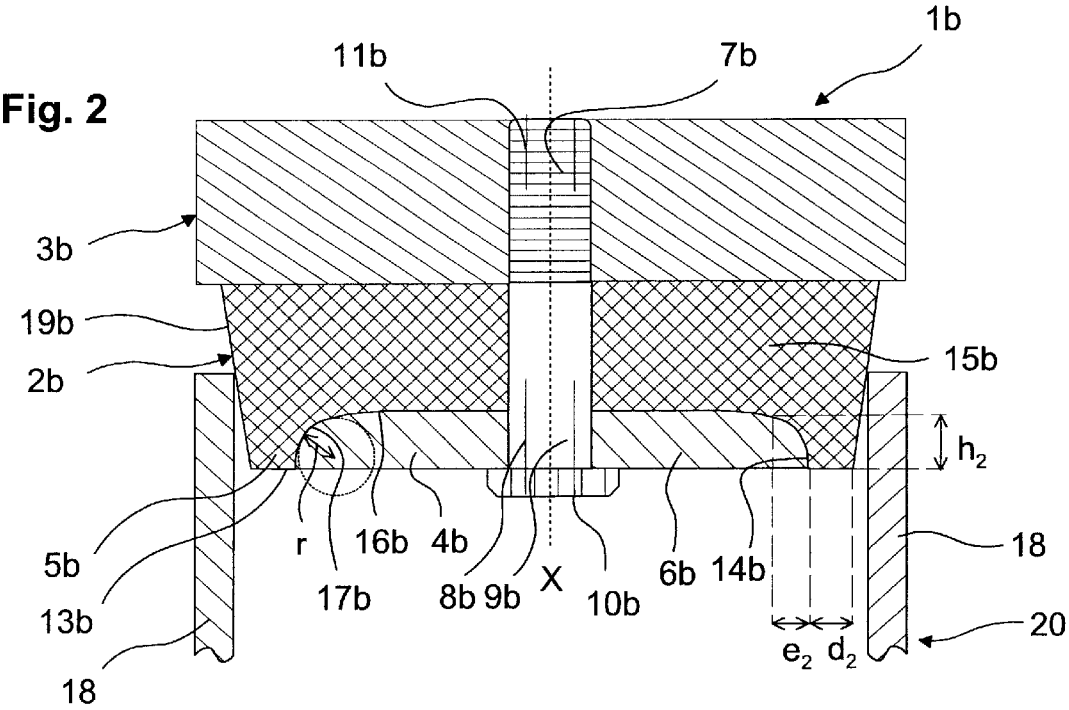
FIG. 2: a cross-section through a further die according to the invention.
Figure 3:
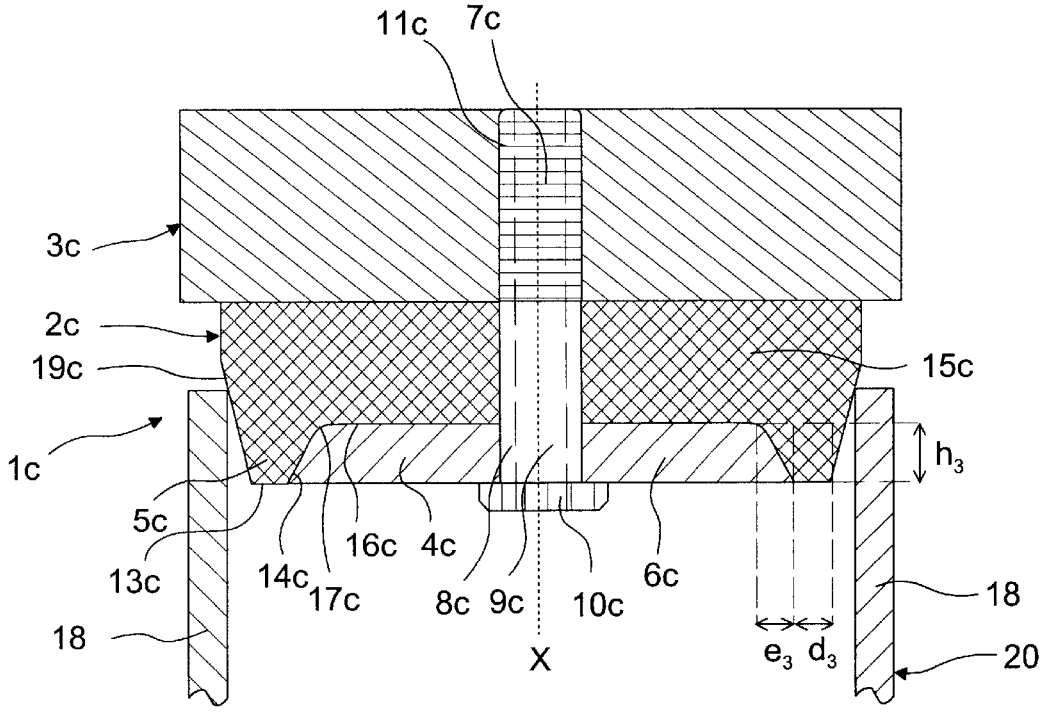
FIG. 3: a cross-section through a further die according to the invention.

The die 1*a,b,c* according to FIGS. 1, 2 and 3 contains a collar 2*a,b,c* of polyurethane arranged on a carrier part 3*a,b,c*. The collar 2*a,b,c* has a pocket-like recess 4*a,b,c* arranged on a base part 15*a,b,c* and bordered on the periphery by a ring flange 5*a,b,c* and towards the carrier part 3*a,b,c* by the face 16*a,b,c* of the base part 15*a,b,c*. In the pocket-like recess 4*a,b,c* is provided a preload plate 6*a,b,c* of steel. The preload plate 6*a,b,c*, the collar 2*a,b,c* and the carrier part 3*a,b,c* have a mutually aligned passage opening 7*a,b,c*. In the passage opening 7*a,b,c*, from the direction of the preload plate 6*a,b,c*, is introduced a screw 8*a,b,c* with a through-bore 9*a,b,c* which lies with the screw head 10*a,b,c* on the preload plate 6*a,b,c* and is screwed and anchored by way of a thread 11*a,b,c* in the carrier plate 3*a,b,c*. The collar 2*a,b,c* contains an external wall 19*a,b,c* formed by the base part 15*a,b,c* and the ring flange 5*a,b,c* and which tapers towards the ring flange end face 13*a,b,c*.

In the position of die 1*a,b,c* ready for operation, the collar 2*a,b,c* conforms to the walls 18 of the profile chamber 20.

The stop point of the profile chamber face effective for the seal for the forming process lies on the tapering wall section of outer wall 19*a,b,c* behind the ring flange 5*a,b,c* in the base part 15*a,b,c*.

The ring flange inner wall 14*a* according to the design in FIG. 1 is substantially parallel to the die longitudinal axis x. In the transition area from the ring flange inner wall 14*a* to the face end 16*a* of the collar 2*a*, the edge is broken by means of a corner surface 17*a* so that the ring flange 5*a* towards the face end 16*a* forms a foot-like expansion with maximum diameter $e_1$. The maximum diameter $e_1$ of the foot-like expansion corresponds approximately to diameter $d_1$ of the ring flange 5*a* in the area of the ring flange end face 13*a*. The maximum diameter $e_1$ of the foot-like expansion also corresponds approximately to half the height $h_1$ of the ring flange 5*a*, or is larger. The edges at the transition from the corner surface 17*a* to the ring flange inner walls 14*a* and to the face 16*a* are rounded and are enclosed in an angle of the adjacent walls or surfaces of around 135°.

The ring flange inner wall 14*b* according to the embodiment in FIG. 2 is substantially parallel to the die longitudinal axis x. In the transition area from the ring flange inner wall 14*b* to the face 16*b* of the collar 2*b*, the edge is broken by means of a curved surface 17*b* so that the ring flange 5*b* towards the face 16*b* forms a foot-like expansion with a maximum diameter $e_2$. The radius r of the circle bordering the curved surface corresponds approximately to half the height $h_2$ of the ring flange 5*b* or is larger. The maximum diameter $e_2$ of the foot-like expansion again corresponds approximately to diameter $d_2$ of the ring flange 5*b* in the area of the ring flange end face 13*b*. Furthermore, the maximum diameter $e_2$ of the foot-like expansion corresponds approximately to half the height $h_2$ of the ring flange 5*b*, or is larger.

The ring flange inner wall 14*c* according to the embodiment in FIG. 3 tapers starting from the face 16*c* of the collar 2*c* towards the ring flange end face 13*c* so that the ring flange 5*c* forms towards the face 16*c* a foot-like expansion with the maximum diameter $e_3$. In the transition area from the ring flange inner wall 14*c* to the face 16*c* the edge is broken in addition by means of a curved surface 17*c*. The maximum diameter $e_3$ of the foot-like expansion corresponds approximately to the diameter $d_3$ of the ring flange 5*c* in the area of the ring flange end face 13*c*. Furthermore, the maximum diameter $e_3$ of the foot-like expansion corresponds approximately to half the height $h_3$ of the ring flange 5*c*, or is larger.

Figure 4:
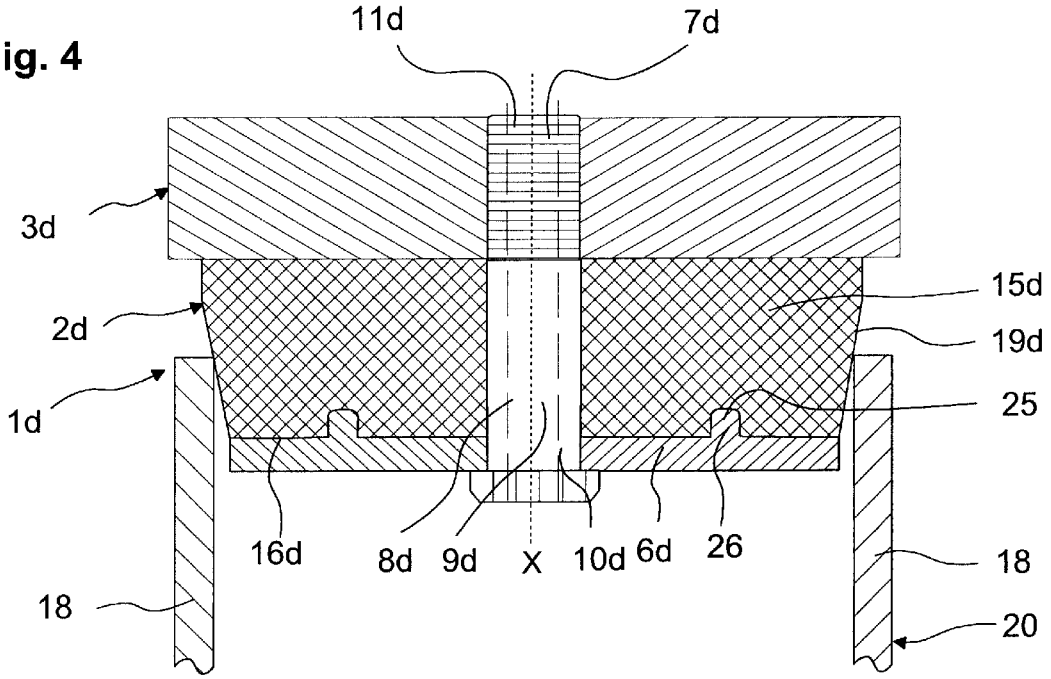
FIG. 4: a cross-section through a further die according to the invention.

A further design according to FIG. 4 of the die id according to the invention contains a collar 2*d* of a polyurethane, arranged on a carrier part 3*d*. The collar 2*d* substantially consists of a base part 15*d* and contains on its face 16*d* groove or hole-like recesses 25. On the face 16*d* is arranged a preload plate 6*d* of steel which contains mouldings 26 corresponding to the recesses 25. The mouldings 26 engage tightly in the recesses 25 and secure the preload plate 6*d* against twisting about the die longitudinal axis x. The preload plate 6*d*, the collar 2*d* and the carrier part 3*d* have a mutually aligned passage opening 7*d*. Inserted into the passage opening 7*d* from the direction of the preload plate 6*d*, is a screw 8*d* with a through-bore 9*d*, which lies with its screw head 10*d* on the preload plate 6*d* and by way of a thread lid is screwed and anchored into the carrier plate 3*d*. The outer wall 19*d* of the base part 15*d* tapers towards the face 16*d*.

Before insertion of the die 1*a,b,c,d* into its operating position, the preload plate 6*a,b,c,d* according to FIGS. 1, 2, 3, 4 is clamped by the screw 8*a,b,c,d* such that the collar 2*a,b,c,d* is clamped sandwich-like between the preload plate 6*a,b,c,d* and the carrier part 3*a,b,c,d* and where applicable undergoes a sideways expansion. The extent of the applied clamping force and hence the extent of the squeezing and expansion of collar 2*a,b,c,d* is dependent on the existing tolerances between the collar 2*a,b,c,d* and the profile chamber walls 18.

Figure 5A:
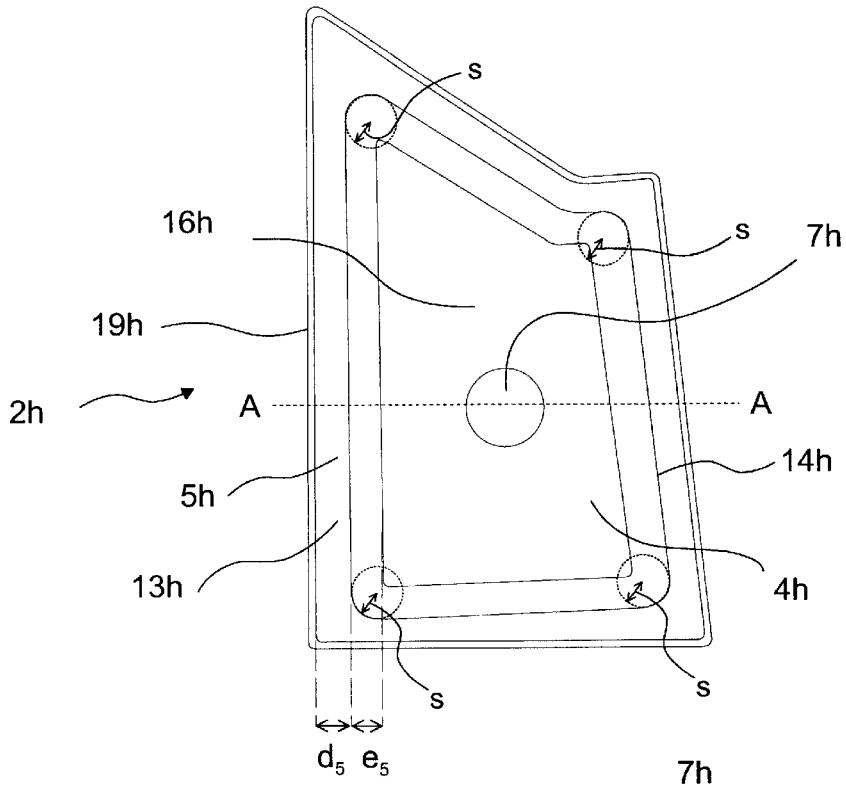
FIG. 5*a*: a top view of the collar of a die according to the invention.
Figure 5B:
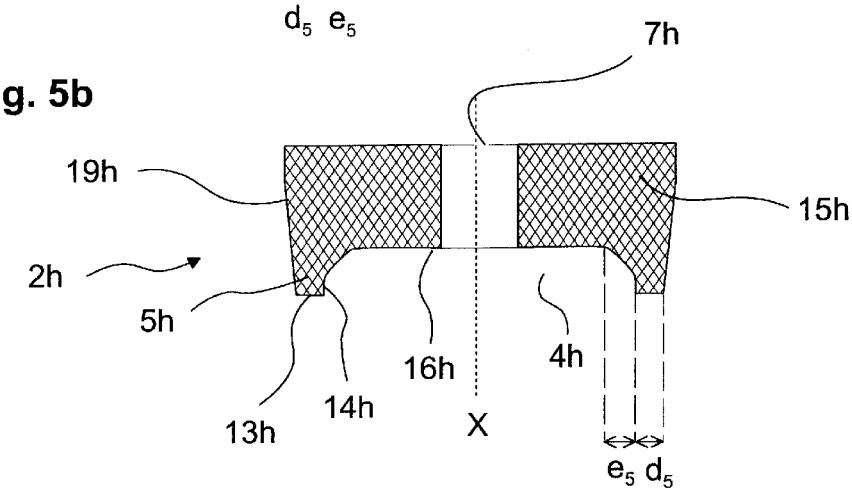
FIG. 5*b*: a diagrammatic cross-section through FIG. 5*a* along line A—A.
Figure 8:
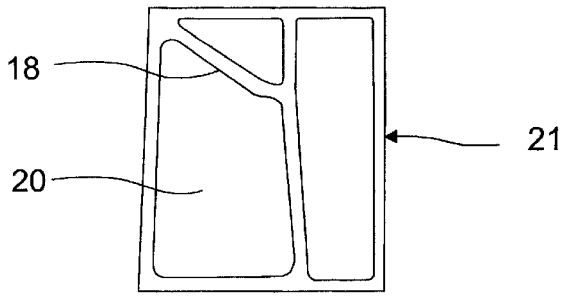
FIG. 8: a cross-section through a multi-chamber profile.

FIG. 5*a* shows in top view a collar 2*h* of the design according to the invention. The same collar 2*h* is shown in cross-sectional view in FIG. 5*b* along line A—A. The outer wall 19*h* of the base part 15*h* describes a polygonal outline which corresponds to the cross-sectional geometry of a corresponding profile chamber 20 of a multi-chamber profile 21 (see FIG. 8). The outer contour of the collar 2*h* given by the outer wall 19*h* is accompanied by a ring flange 5*h* shown in FIG. 5*a* by the ring flange end face 13*h*. The ring flange 5*h* encloses a pocket-like recess 4*h* which is visible in FIG. 5*a* by its face 16*h*. Arranged centrally is a passage opening 7*h* for a screw connection with through-bore for a pressure medium supply and/or extraction channel.

The edges in the transition area of two ring flange sections intersecting at an angle are rounded in the area of the inner ring flange wall 14*h*. Said transition area is preferably bordered by a curved piece with circle radius s. Said circle radius s corresponds to or is larger than half the diameter $e_5$ of the maximum foot-like expansion of the ring flange 5*h*. The diameter $d_5$ of the ring flange end face 13*h* corresponds approximately to the maximum diameter $e_5$ of the foot-like expansion. The outer wall 19*h* of the base part 15*h* tapers in the direction of the ring flange end face 13*h*.

Figure 6:
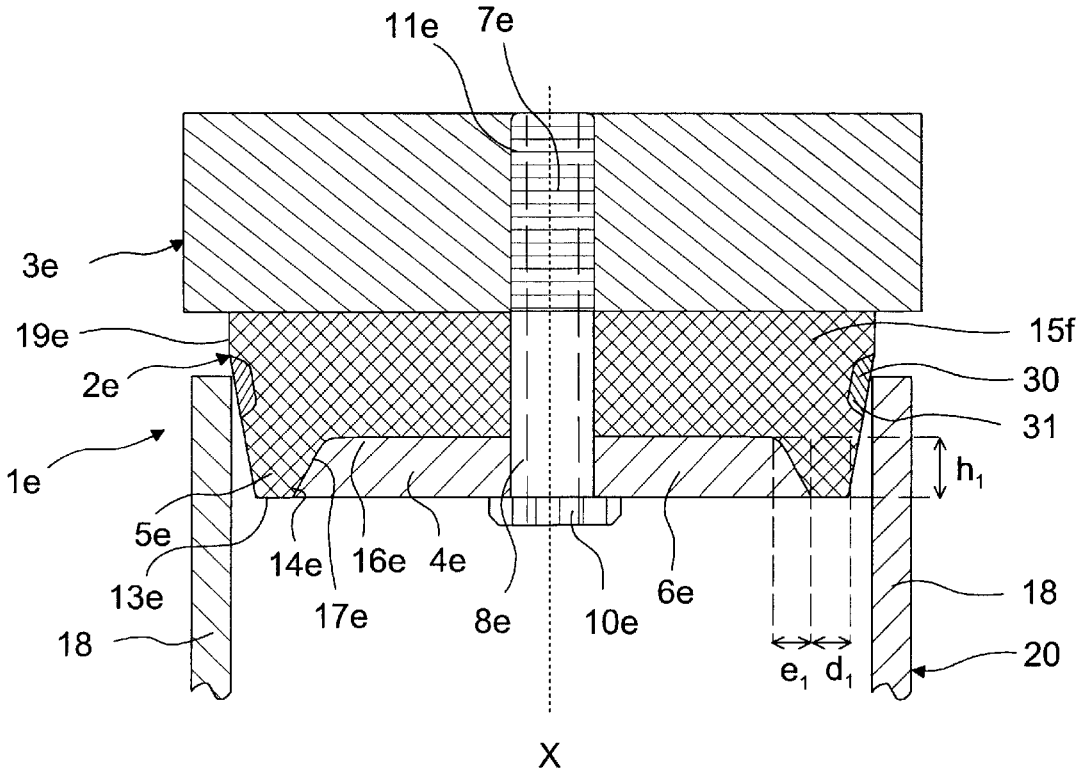
FIG. 6: a cross-section through a die according to the invention with wear protection.

In a further embodiment of the invention according to FIG. 6 a wear protection device is provided in a die 1*e* produced according to the description in FIG. 3. The wear protection takes the form of a strip-like wear section 30 inset into a groove-like recess 31 in the tapering outer wall 19*e* of the base part 15*e*. The outer wall of the wear strip 30 aligns with the outer wall 19*e* of the base part 15*e*. The wear strip 30 is made of steel.

Figure 7:
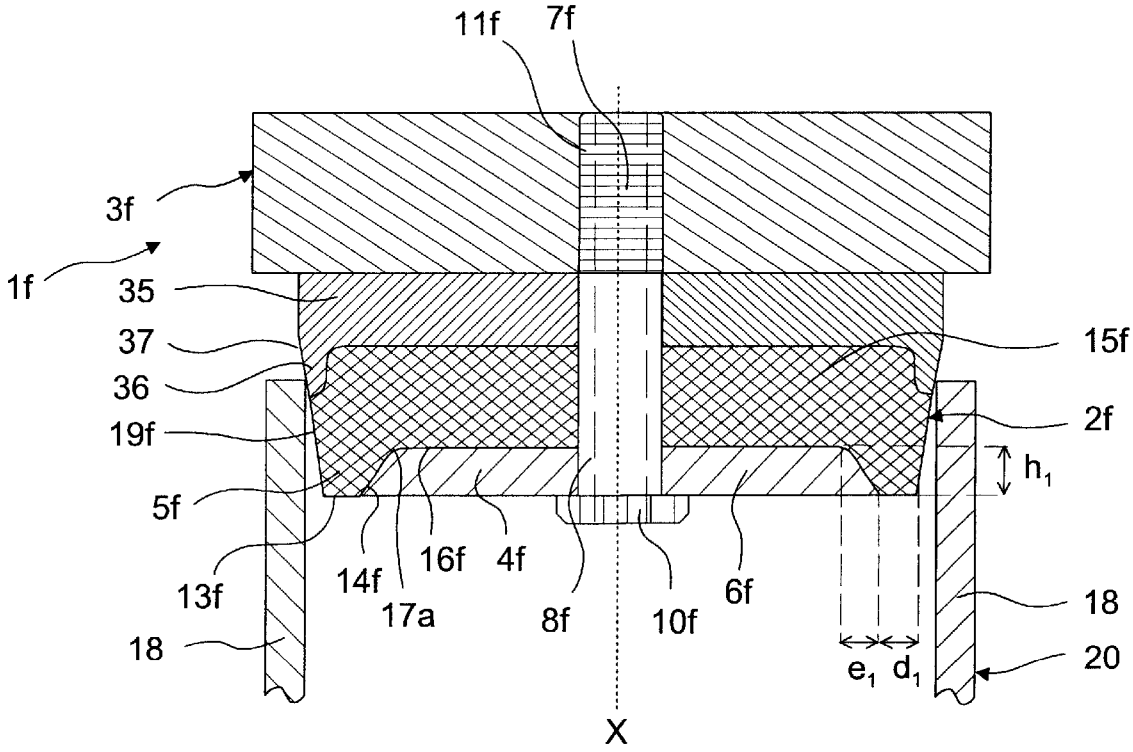
FIG. 7: a cross-section through a further die according to the invention with wear protection.

In a further embodiment of the invention according to FIG. 7, a wear protection device is provided in a die if produced according to the description in FIG. 3. Between the carrier part 3*f* and the collar 2*f* is arranged a plate-like intermediate part 35 with a bead-like edge 36 of steel. The bead-like edge 36 forms a wear protection on the tapering outer wall 19*f* of the base part 15*f*. The bead-like edge 36 has for this an outer surface 37 running in alignment to the outer wall 19*f* i.e. tapering. The bead-like edge 36 thus forms a wear edge protruding into the outer wall 19*f* of the base part. The intermediate part 35 also has a passage opening aligned with the passage opening 7*f* of the preload plate 6*f*, the collar 2*f* and the carrier plate 3*f*, for passage of a fixing bolt 8*f* with a through-bore 9*f*. The fixing means 8*f* anchoring the preload plate 4*f* can also be anchored in the intermediate part 35.

The design of the ring flange 5*e,f* in FIGS. 6 and 7 and its walls 13*e,f*, 14*e,f*, 17*e,f* and in particular the design of the transition area from the ring flange wall 14*e,f* to the face 16*e,f* and the anchoring of the collar 2*e,f* in the carrier part 3*e,f*, corresponds to the statements on FIG. 3. The corresponding features can be taken from the associated description. Said design of the ring flange 5*f* and its walls, and in particular the design of the transition area from the ring flange inner wall, and the transition area can also correspond to FIGS. 1 and 2. Furthermore, the wear protection described above and its embodiments can also be applied to the design variant shown in FIG. 4.

Figure 9A:
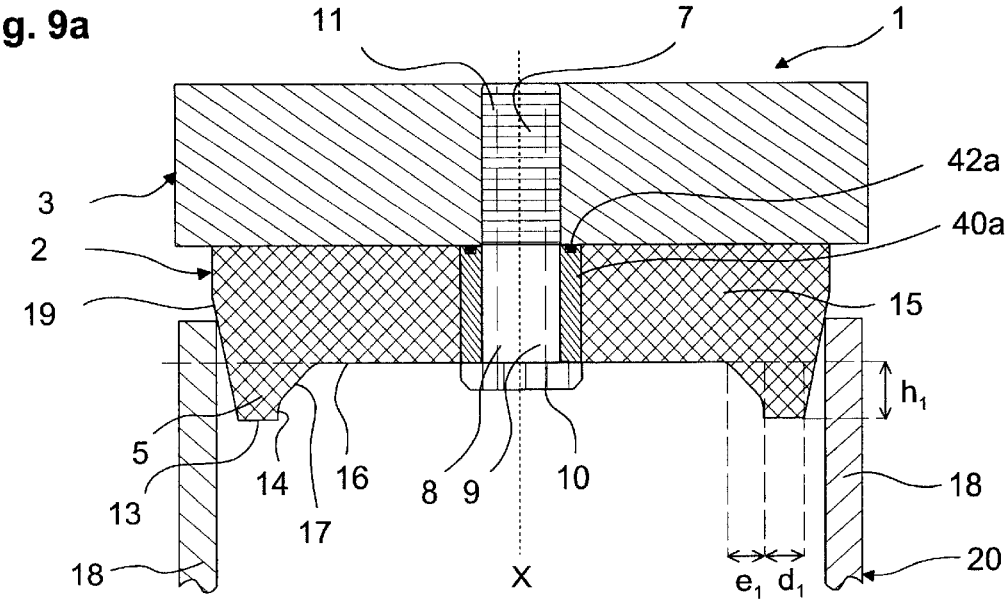
FIG. 9*a*: a cross-section through a die according to the invention with reinforcement bush.

FIG. 9*a* shows a further embodiment of a die 1 according to the invention. The die contains a collar 2 of a polyurethane arranged on a carrier part 3. The collar 2 has a face 16 and a peripheral ring flange 5 with a ring flange end face 13. The collar 2 has an outer wall 19, formed by the base part 15 and the ring flange 5, which tapers towards the ring flange end face 13. The design of the outer wall 19, ring flange 5 and foot-like expansion corresponds to the description in FIG. 1*a*.

The collar 2 and the carrier part 3 have a mutually aligned passage opening 7. Let into the passage opening 7 is a reinforcement bush 40*a* which is formed as a hollow cylinder running d parallel to the die longitudinal axis x. The reinforcement bush 40*a* is inset lying tightly in the passage opening 7. From the direction of the face 16 a bolt 8 with a through-bore 9 is let into the passage opening or reinforcement bush 40*a*. The bolt 8 lies with its bolt head 10 on the face end of the reinforcement bush 40*a* and is screwed into the carrier plate 3 by way of a thread 11.

On the face end of the reinforcement bush 40*a* facing the carrier part 3 a sealing ring 42*a* is let into an annular groove opening and seals the separating area between the collar 2 and the carrier part 3 towards the passage opening 7 against the penetrating pressure medium.

The collar 2 conforms to the walls 18 of the profile chamber 20 when the die 1 is in the position ready for operation. The stop point of the profile chamber face effective for sealing for the forming process lies on the tapering wall section of the outer wall 19, behind the ring flange 5 in the base part 15.

Figure 9B:
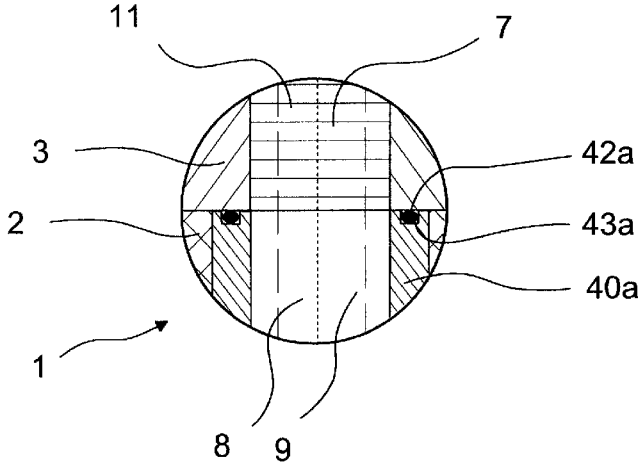
FIG. 9*b*: an enlarged extract from the area of the reinforcement bush according to FIG. 9*a;*

FIG. 9*b* shows an enlarged extract from the area of the reinforcement bush 40*a* according to FIG. 9*a*. An annular groove opening 43*a* on the face end towards the carrier part 3 holds a sealing ring 42*a* which, when the reinforcement bush 40*a* makes contact by its face end with the carrier part 3, seals the border area between the collar 2 and the carrier part 3 towards the passage opening 7.

FIGS. 9*c–f* show various embodiments of reinforcement bushes 40*b,c,d,e* which are arranged in the passage opening 7 in the base part 15 of the collar 2. The embodiments of the reinforcement bushes 40*b,c,d,e* according to the invention can be used in any of the dies according to the invention described above.

Figure 9C:
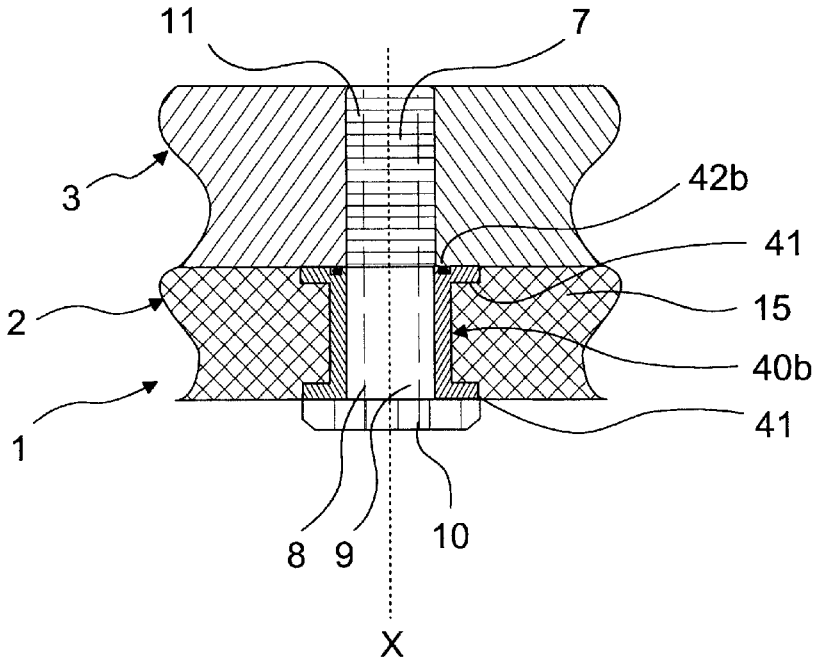
FIGS. 9*c–f*: an extract through a die according to the invention in cross-section with various reinforcement bushes.

In FIG. 9*c* the reinforcement bush 40*b* is formed as a cylindrical bush running parallel to the die longitudinal axis x and has at both ends an annular collar 41 which stops the pressure medium being able to penetrate the separating area between the collar 2 and the reinforcement bush 40*b*.

Figure 9D:
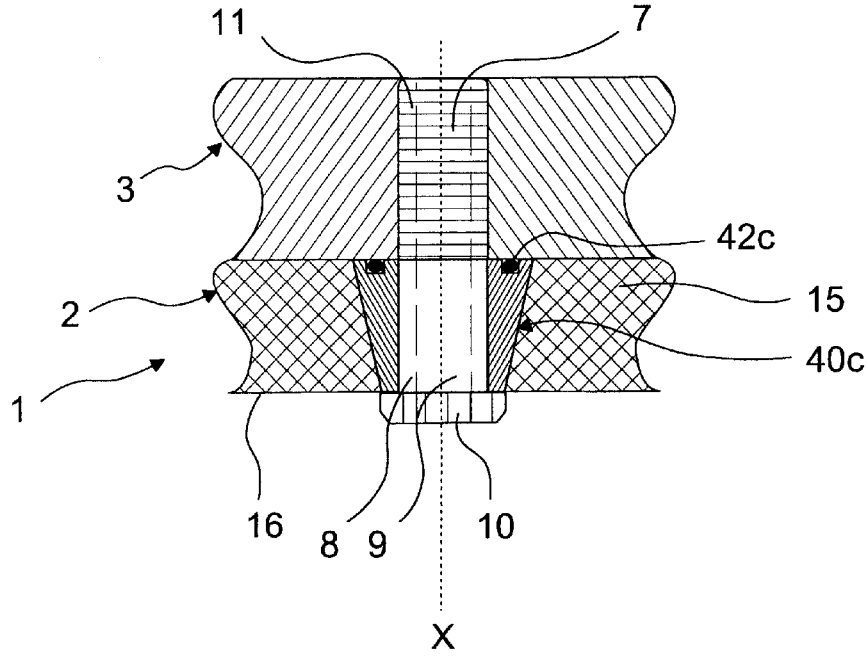

In FIG. 9*d* the outer surface of the reinforcement bush 40*c* is formed conical where the outer surface tapers towards the face 16. The inner face of the reinforcement bush 40*c* runs parallel to the die longitudinal axis x.

Figure 9E:
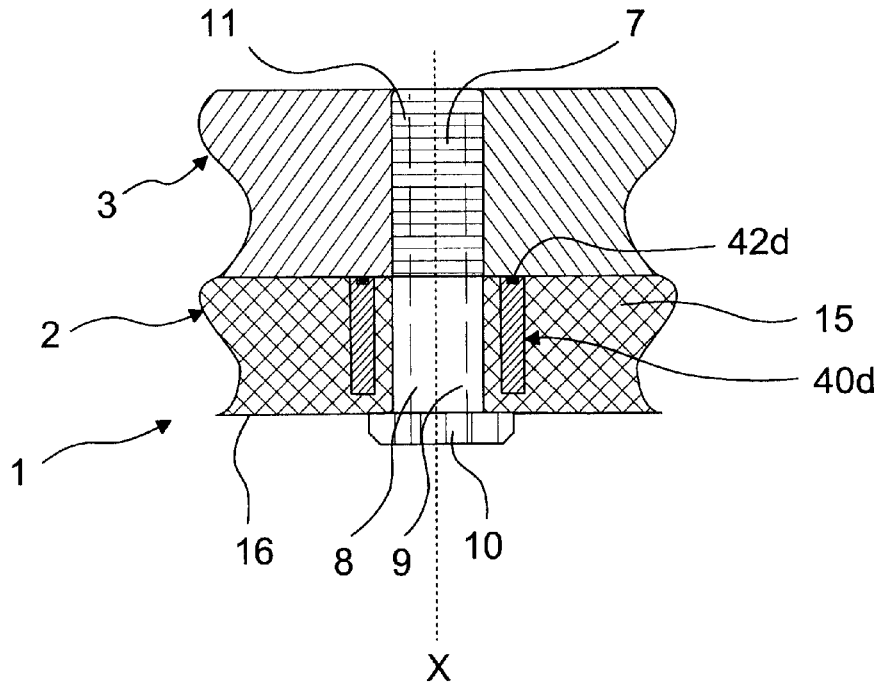

In FIG. 9*e* the reinforcement bush 40*d* is formed as a cylindrical bush running parallel to the die longitudinal axis x. The reinforcement bush 40*d* is arranged about the passage opening 7 and in inset integral into the base part 15 of the collar 2. The reinforcement bush 40*d* can be cast or pushed in, or where applicable glued in.

Figure 9F:
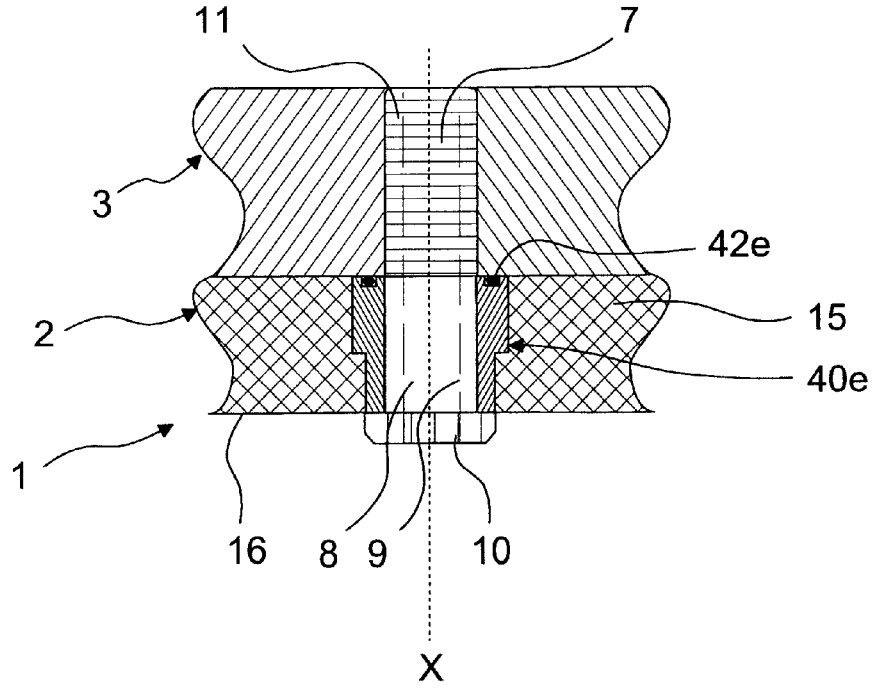

The reinforcement bush 40*e* shown in the design according to FIG. 9*f* is a cylindrical bush running parallel to the die longitudinal axis x with the stepped wall thickness. The thickening is step-like and arranged in the center area of the reinforcement bush 40*e*, where the thinner wall of the reinforcement bush 40*e* is arranged towards the face 16.

The thickening of the reinforcement bush 40*c,e* towards the carrier part 3 according to FIGS. 9*d* and 9*f* is based on the fact that the outer wall 19 of the collar 2 towards the carrier part 3 is exposed to atmospheric pressure outside the profile chamber 20, while the outer wall 19 of the collar 2 starting from the stop point of the profile chamber walls 18 against the face 6 lies within the profile chamber 20 and is also exposed to the internal high pressure. The forces acting radially in the passage opening 7 consequently cause greater radial deformation of the collar towards the carrier part 3 than towards the face 16, so the reinforcement bush 40*d,e,f* is formed to be more solid towards the carrier part 3.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A device for forming a hollow profile formed as a single or multi-chamber profile by an internal high pressure generated by a fluid pressure medium within the hollow profile, the device comprising a sealing die having a carrier part engageable in a profile chamber and a collar arranged on the carrier part so as to seal a face of the profile chamber, the collar having a base part, the carrier part and the collar having a passage opening as a pressure medium supply and extraction channel, the collar being a resilient rubber die part arranged on a face of the carrier part facing the profile chamber, the base part being a block-like member with an outer wall formed conical at least in an end section facing the profile chamber and tapering towards the profile chamber whereby a stop point of the profile chamber face which is effective for sealing for forming lies on the conical section of the outer wall of the base part.

2. A device according to claim 1, wherein the taper of the outer wall of the base part to a die longitudinal axis x encloses a angle of more than 0° and less than 20°.

3. A device according to claim 2, wherein the taper of the outer wall encloses an angle of more than 3° and less than 20°.

4. A device according to claim 2, wherein the taper of the outer wall encloses an angle of more than 0° and less than 10°.

5. A device according to claim 2, wherein the taper of the outer wall encloses an angle of more than 3° and less than 10°.

6. A device according to claim 1, and further comprising a preload plate mounted on a free face of the base part so as to be twist-resistant, and fixing means for anchoring the preload plate and preloading the collar.

7. A device according to claim 6, wherein the fixing means penetrate the preload plate and the collar, and are anchored in a die part lying opposite the preload plate so as to fix the preload plate to the die part with squeezing constriction of the collar.

8. A device according to claim 7, wherein the fixing means are anchored in the carrier part which lies directly on the collar.

9. A device according to claim 6, wherein the fixing means includes a bolt that penetrates the collar and fixes the preload plate by way of one of screw heads and washer elements and is screwed into the carrier part.

10. A device according to claim 6, wherein the fixing means includes a fixing bolt arranged to penetrate the passage opening and is screwed into the carrier part so as to anchor the preload plate, the carrier part having a through-bore that serves as the pressure medium supply and extraction channel.

11. A device according to claim 6, and further comprising a reinforcement bush arranged in the collar so as to surround the passage opening, the fixing means penetrating the passage opening so as to fix the collar to a die part lying against the collar, whereby the reinforcement bush absorbs any deformation forces exerted radially outwardly by pressure medium in the passage opening.

12. A device according to claim 2, wherein the reinforcement bush lies flush in a sealing manner on a wall of the passage opening in the collar.

13. A device according to claim 12, wherein the reinforcement bush is arranged in the passage opening so as to radially preload the collar in the area of the passage opening by resilient expansion of the passage opening.

14. A device according to claim 11, wherein the reinforcement bush surrounding the passage opening is integral in the collar.

15. A device according to claim 14, wherein the reinforcement bush is cast into the collar.

16. A device according to claim 6, wherein the fixing means includes a fixing bolt with a through-bore screwed into the carrier part and penetrating the passage opening whereby the through-bore serves simultaneously as a pressure medium supply and extraction channel.

17. A device according to claim 1, wherein the collar has a face facing the profile chamber which contains a pocket-like recess peripherally surrounded at least partially by a ring flange.

18. A device according to claim 17, wherein the ring flange has a ratio of height $h_1$ to diameter $d_1$ at its end face of 0.5 to 3.

19. A device according to claim 18, wherein the ring flange has a ratio of height to diameter of about 1 to about 2.

20. A device according to claim 17, wherein edges in a transition area between a ring flange inner wall and the face of the collar are at least one of broken and rounded.

21. A device according to claim 17, wherein the ring flange in a transition area to the face has a foot-like expansion in the pocket-like recess, the foot-like expansion having a maximum diameter $e_1$ that corresponds at least to a third of a total height $h_1$ of the ring flange.

22. A device according to claim 21, wherein the maximum diameter $e_1$ corresponds to at least one-half the total height $h_1$.

23. A device according to claim 17, wherein the ring flange inner wall transforms into the face by way of a curved surface.

24. A device according to claim 23, wherein the ring flange inner wall transforms into the face by a circular curved surface.

25. A device according to claim 17, wherein, in a transition area between the ring flange inner wall and the face, at least one corner surface is provided that forms a foot-like expansion, walls abutting the corner surfaces enclosing an angle of more than 90°.

26. A device according to claim 25, wherein the walls abutting the corner enclose an angle of more than 110°.

27. A device according to claim 26, wherein the walls abutting the corner surfaces enclose an angle of more than 130°.

28. A device according to claim 6, wherein the preload plate is embedded twist-resistant across the die longitudinal axis x in a pocket-like recess of the collar with at least corresponding geometric shape, and the preload plate is surrounded tightly by an adjacent ring flange.

29. A device according to claim 28, wherein the preload plate and the recess have a corresponding geometric shape and dimension.

30. A device according to claim 6, wherein the preload plate contains mouldings that engage tightly in groove-like recesses of the collar as twist resistance.

31. A device according to claim 7, wherein the preload plate is attached freely mobile in the die longitudinal axis direction x, and the fixing means form an outer stop of the preload plate directed towards the profile chamber so that the preload plate during a forming process is pressable by pressure impact of pressure medium against the carrier part thereby increasing the squeezing pressure on the collar.

32. A process for forming a single or multi-chamber profile by an internal high pressure generated by a fluid pressure medium in a sealed profile chamber of the chamber profile, with a device having a sealing die having a carrier part engageable in a profile chamber and a collar arranged on the carrier part so as to seal a face of the profile chamber, the collar having a base part, the carrier part and the collar having a passage opening as a pressure medium supply and extraction channel, the collar being a resilient rubber die part arranged on a face of the carrier part facing the profile chamber, the base part being a block-like member with an outer wall formed conical at least in an end section facing the profile chamber and tapering towards the profile chamber whereby a stop point of the profile chamber face which is effective for sealing for forming lies on the conical section of the outer wall of the base part, the process comprising the steps of: introducing the die into the profile chambers of the chamber profile so that the collar of the die tightly seals the face opening of the profile chamber; introducing a pressure medium into the profile chamber by way of a pressure supply line; anchoring and clamping a preload plate lying on a face of the collar with fixing means squeezing the collar, in a die part lying adjacent to the collar and opposite the preload plate so that tolerances between the die and the chamber walls are compensated.

33. A process according to claim 31, wherein by clamping the preload plate and squeeze-clamping the collar at least one of a ring flange and an outer wall of the collar are pressed outwards in a direction of the chamber walls.

* * * * *